US006488525B2

(12) United States Patent
Abel et al.

(10) Patent No.: US 6,488,525 B2
(45) Date of Patent: Dec. 3, 2002

(54) WIRE LEAD GUIDE FOR COMMUNICATION CONNECTORS

(75) Inventors: John N. Abel, Avon, IN (US); Larry E. Fortner, Indianapolis, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/832,271

(22) Filed: Apr. 10, 2001

(65) Prior Publication Data

US 2002/0146929 A1 Oct. 10, 2002

(51) Int. Cl.[7] ..... H01R 11/20
(52) U.S. Cl. ..... 439/404; 439/934
(58) Field of Search ..... 439/676, 934, 439/941, 660, 344, 418, 395, 894, 76.1, 417, 406, 405, 751, 82; 361/759, 82, 752, 736, 728

(56) References Cited

U.S. PATENT DOCUMENTS 4,262,985 A * 4/1981 Muehlhausen, II ..... 439/400
5,525,078 A * 6/1996 Springer ..... 439/610
5,624,274 A * 4/1997 Lin ..... 439/417
5,688,145 A * 11/1997 Liu ..... 439/607
5,905,637 A * 5/1999 Su ..... 361/752
5,924,896 A 7/1999 Arnett
6,083,052 A * 7/2000 Adams et al. ..... 439/676
6,116,964 A 9/2000 Goodrich
6,157,542 A * 12/2000 Wu ..... 361/752
6,315,596 B1 * 11/2001 Chen ..... 439/417

* cited by examiner

*Primary Examiner*—Neil Abrams
*Assistant Examiner*—J. F. Duverne

(57) ABSTRACT

A wire lead guide arrangement provided on a terminal housing of a communication connector. The terminal housing includes a base wall, and two rows of terminal posts disposed at opposite sides of the base wall. The terminal posts are configured to receive outside wire leads for establishing connections between the leads and connector terminals associated with the terminal posts. A wire guide structure in the form of a wall or bar extends between the two rows of terminal posts. The guide structure is configured to separate and prevent interaction between a first set of leads terminating at one row of the terminal posts, and a second set of leads terminating at the other row of terminal posts. The arrangement avoids variations in lead placement that might tend to degrade rated connector performance, particularly with respect to near end crosstalk (NEXT).

7 Claims, 4 Drawing Sheets

WIRE LEAD GUIDE FOR COMMUNICATION CONNECTORS

BACKGROUND OF THE INVENTION

1. Field of the Invention

This invention relates to communication connectors for use with cables whose conductors carry multiple signal or data channels.

2. Discussion of the Known Art

Typical multi-channel or network types of communication connectors (e.g., type RJ-45) have four pairs of contact wires that carry corresponding signal or data channels through the connectors. Crosstalk occurs when signals of one channel carried by a first pair of contact wires in the connector, are partly transferred by inductive or capacitive coupling into another channel carried by a second pair of contact wires in the same connector. The transferred signals produce "crosstalk" in the second channel, and such crosstalk degrades existing signals routed over the second channel. Commercially available communication connectors, for example, the MGS 200 and MGS 300 series of modular connectors available from Avaya Inc., incorporate wire traces or other elements on printed wire boards within the connectors, for purposes of reducing or compensating for such crosstalk. See U.S. Pat. No. 5,924,896 (Jul. 20, 1999) and U.S. Pat. No. 6,116,964 (Sep. 12, 2000), all relevant portions of which are incorporated by reference.

Communication connectors also have a number (e.g., eight) of connector terminals to which outside wire leads, for example, leads of an unshielded twisted pair (UTP) cable, are electrically connected. The terminals are themselves connected to corresponding ones of the contact wires of the connector either directly, or via a printed wire board supported in the connector housing.

UTP cables typically include four twisted pairs of insulated wire leads for carrying four different signal or data channels over the length of the cable. Each pair of leads must therefore be adequately supported or dressed next to a terminal housing on the connector, prior to termination of the lead pair at a corresponding pair of connector terminals on or in the terminal housing. Problems are known to arise in that variations of such lead dress in the field have compromised connector performance, particularly with respect to a connector's near-end crosstalk (NEXT) rating.

Communication connectors for use with UTP or other kinds of cables are now expected to support data rates up to not only 100 MHz to meet industry "Category 5" performance, but to meet or exceed Category 6 ratings which call for at least 46 dB crosstalk loss between any two channels at 250 MHz. It is therefore important that any variations of lead dress near the connector terminals tending to degrade a connector's rated crosstalk performance, be avoided.

SUMMARY OF THE INVENTION

According to the invention, a terminal housing for a communication connector includes a base wall, and first and second rows of terminal posts disposed at opposite sides of the base wall. The terminal posts are configured to receive outside leads for establishing connections between the leads and connector terminals associated with the terminal posts. A lead guide structure extends between the two rows of terminal posts, and the guide structure is dimensioned and formed to separate and prevent interaction between a first set of leads terminating at the first row of terminal posts, and a second set of leads terminating at the second row of posts.

For a better understanding of the invention, reference is made to the following description taken in conjunction with the accompanying drawing and the appended claims.

DETAILED DESCRIPTION OF THE INVENTION

Figure 1:
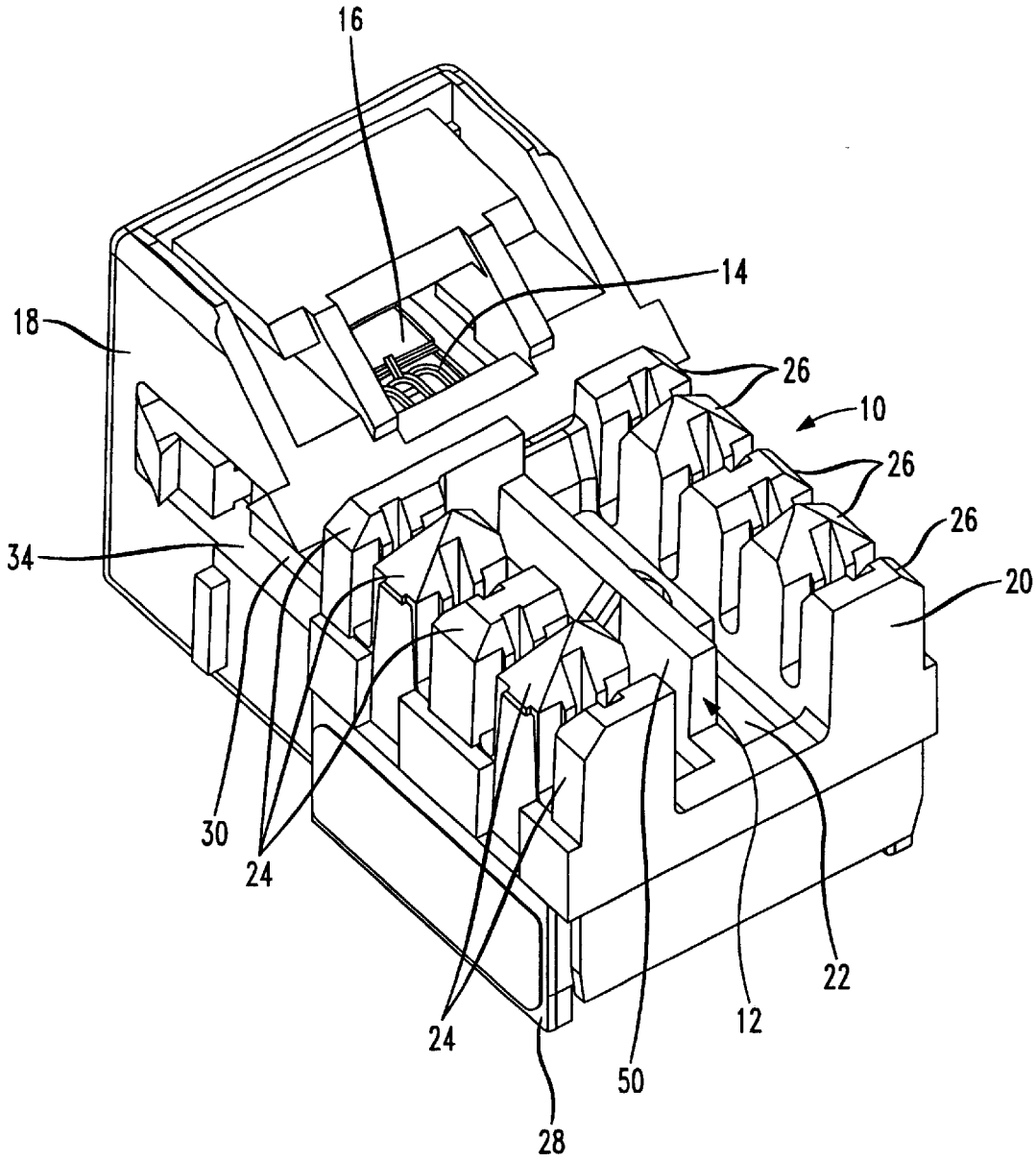
FIG. 1 is a perspective view of a communication connector having a wire lead guide structure according to the invention, as seen from the rear of the connector.

FIG. 1 is a rear perspective view of a communication connector 10 with a wire lead guide structure 12 according to the invention. In the present embodiment, the connector 10 is a modular communication jack of the kind having eight terminal contact wires 14 formed and arranged to establish electrical connections with corresponding terminals of a mating plug connector (not shown). The contact wires 14 are supported on, e.g., a wire board 16, and the board 16 with the contact wires 14 arrayed at a leading portion of the board, is supported inside a jack frame 18.

A rear portion of the wire board 16 (not visible in FIG. 1) supports eight connector terminals which are protectively surrounded by a terminal housing 20. The connector. terminals are typically of a known insulation displacement type, having narrow vertical grooves into which insulated end portions of outside wire leads are pressed. When so pressed, insulation about the end portions of the wire leads is pierced by the terminals, and reliable electrical connections are established between the leads and the associated terminals.

The housing 20 has a base wall 22, and first and second parallel rows of terminal posts 24, 26 that are joined by the base wall 22 and are spaced apart from another at opposite sides of the housing 20. The posts of each row define vertical grooves that open upwardly with respect to the base wall 22, which grooves coincide with the grooves of insulation displacing connector terminals that are protectively surrounded and guarded by the rows of posts 24, 26.

Figure 2:
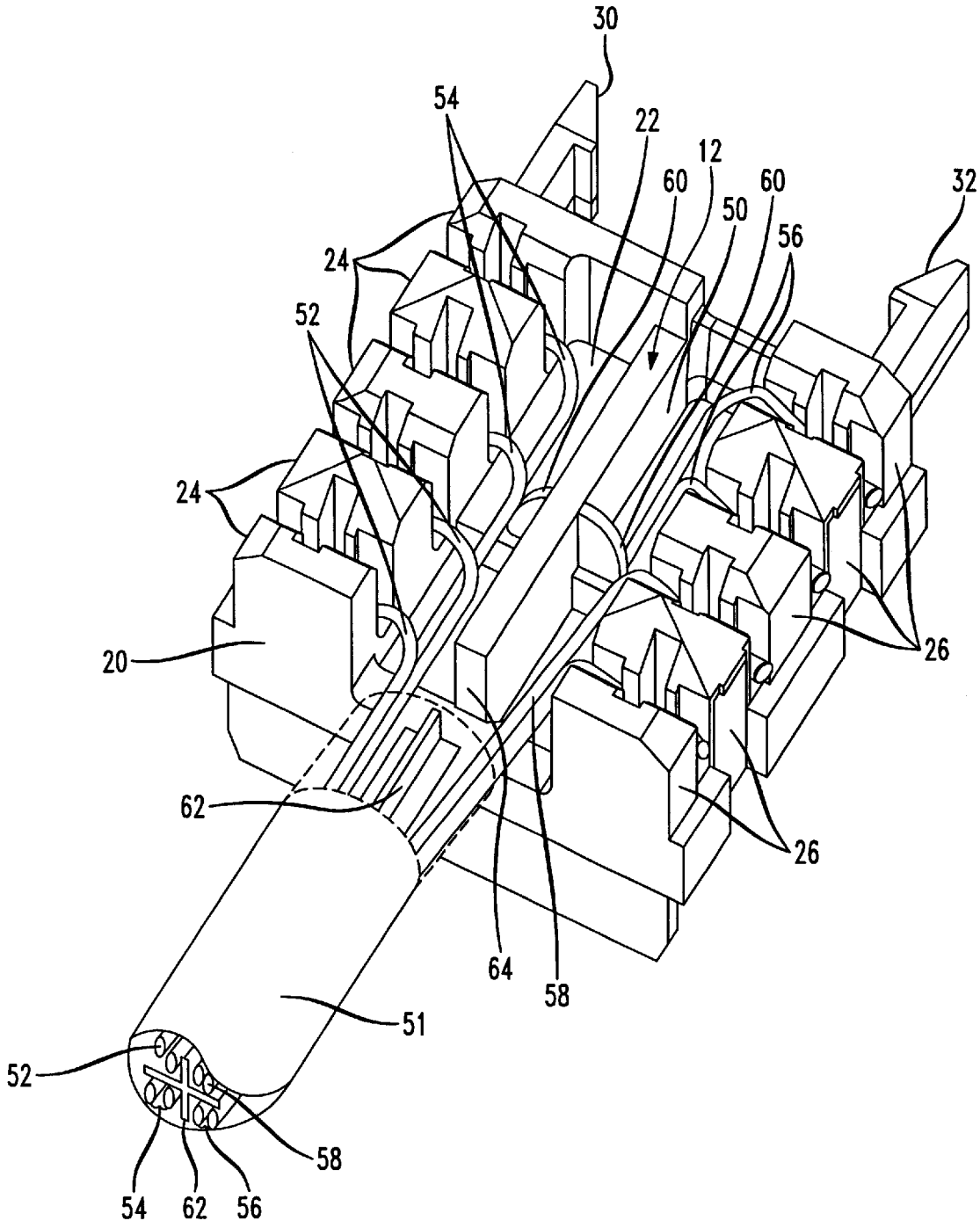
FIG. 2 is a perspective view of a terminal housing of the connector in FIG. 1.

The connector 10 also has a bottom cover 28 for protectively enclosing the rear portion of the wire board 16 below the terminal housing 20. The housing 20 and the cover 28 are preferably joined to one another (e.g., by ultrasonic welding), with the rear portion of the board 16 firmly captured between the housing 20 and the cover 28. As seen in FIG. 2, a forward end of the terminal housing 20 has two toothed catch members 30, 32 that formed to snap into and lock within corresponding recesses 34 in the sides of the jack frame 18, one of which recesses 34 is visible in FIG. 1. In addition to flanges molded on inside walls of the jack frame 18 for receiving and supporting side edges of the wire board 16, the catch members 30, 32 act to provide positive retention between the various parts of the communication connector 10, and to improve its electrical performance by reducing variations in the relative positions of its component parts.

As seen in FIGS. 1 and 2, the wire lead guide structure 12 is in the form of a flat wall or bar 50 that extends upward from the base wall 22 of the terminal housing 20, intermediate the two rows of terminal posts 24, 26 at opposite sides of the terminal housing. An associated cable 51 carries, e.g., four twisted pairs of insulated wire leads 52, 54, 56, 58. As shown in FIG. 2, lead pairs 52 and 54 are terminated at the first row of posts 24 at the left in FIG. 2, and lead pairs 56 and 58 are terminated at the second row of posts 26 at the right in FIG. 2. The wire guide bar 50 is of sufficient height to prevent the lead pairs 52, 54 when routed or dressed along one side of the bar 50, and the lead pairs 56, 58 when dressed along the opposite side of the bar, from contacting or approaching one another in a manner detrimental to the performance of the connector 10. As mentioned, in the absence of the guide structure 12, lead pairs terminated at one of the rows of posts 24, 26 have been known physically to overlap or electrically couple with lead pairs terminated at the other row of posts 26, 24, and thus degrade connector performance especially with respect to near end crosstalk (NEXT).

The wire guide bar 50 may be formed or molded of a suitable plastics material integrally with the terminal housing 20. A pair of shoulders 60 at either side of the bar 50 serve to keep the forward most pairs of leads 54, 56 restrained between the free ends of the shoulders 60 and sides of adjacent terminal posts.

The cable 51 may also contain a separator 62 having an "X" cross-section wherein each of the wire pairs 52, 54, 56, 58 is confined within a 90-degree arc of the separator 62 over the length of the cable 51. When outer insulation is removed at the end of cable 51 prior to terminating the wire lead pairs at the connector 10, it is preferred that the separator 62 be cut at such a position that the cut end of the separator will come into contact against a rear end face 64 of the guide structure 12. Such a configuration will act to reduce relative longitudinal movement between the lead pairs 52, 54, 56, 58 and the terminal housing 20, and help to preserve the rated performance of the connector 10.

Figure 3:
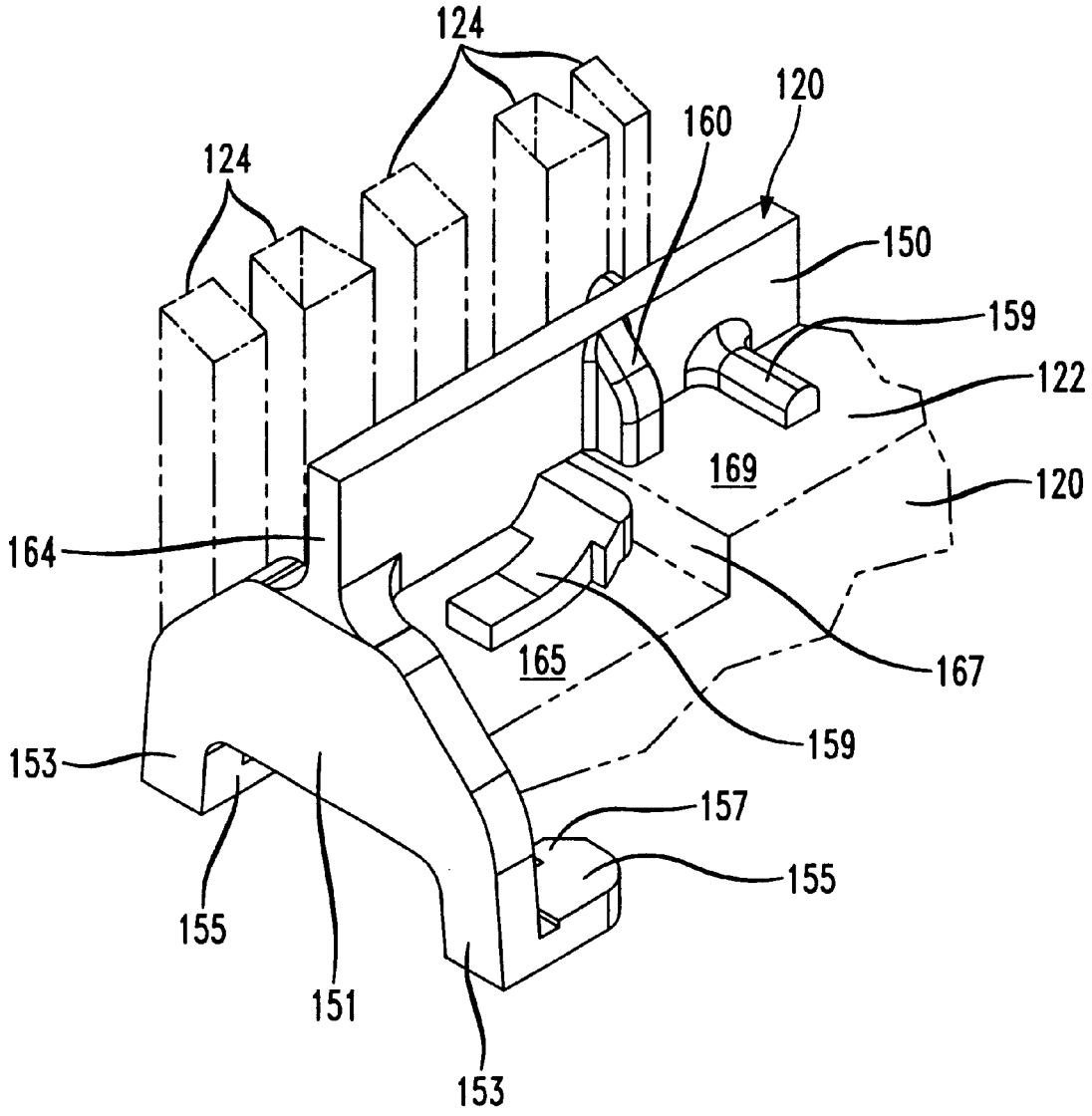
FIG. 3 is a perspective view of a wire lead guide unit constructed for use with an existing communication connector, according to the invention.
Figure 4:
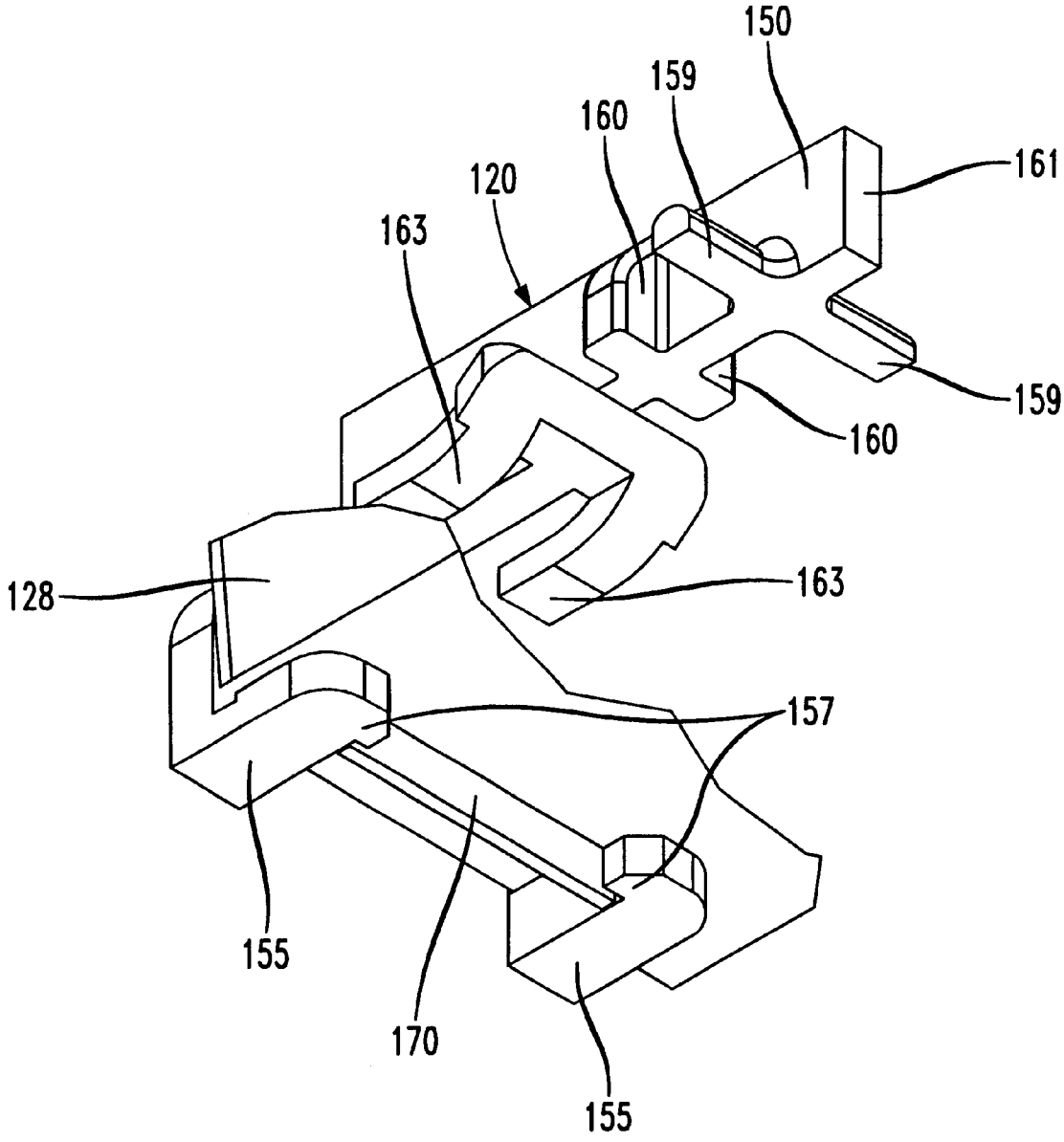
FIG. 4 is a perspective view of the wire lead guide unit of FIG. 3 taken from below, showing a portion of a bottom cover of the existing connector.

FIGS. 3 and 4 show a second embodiment of the invention in the form of a wire lead guide unit 120 for attachment or installation on an existing communication connector. Parts corresponding to those of the embodiment of FIGS. 1 and 2, have the same reference numerals increased by 100.

The guide unit 120 is intended for field installations on communication connectors with terminal housings 120 and covers 128 similar to those of the connector 10 in FIGS. 1 and 2, but having only a base wall 122 between two rows of terminal posts (one row 124 is depicted in FIG. 3) and lacking means equivalent to the guide structure 12.

The guide unit 120 may be in the form of a flat, horizontal bar 150 that is joined at one end in cantilever fashion to the top of a clamp plate 151. The plate 151 has a pair of legs 153 that extend vertically downward with respect to the bar 150. The legs 153 have feet 155 that point in the direction of the free end of the bar 150, and the feet 155 have mutually opposed toe hooks or catches 157 as seen in FIG. 4.

The bar 150 also has a first set of stops 159 extending transversely of a lower edge of the bar near its free end 161. The stops 159 extend just enough so that their distal ends will closely adjoin the walls of adjacent terminal posts at either side of the base wall 122. Accordingly, the free end 161 of the bar 150 is restrained by the stops 159 from side-wise movement after the guide unit 120 is installed.

A second set of stops 163 is joined beneath a portion of the bar 150 closer to the clamp plate 151 than the first set of stops 159, and the second set is dimensioned and configured to rest on a lower level region 165 of the base wall 122, and to abut a step rise 167 between the lower region 165 and an upper level region 169 of the base wall on which the first set of stops 159 are seated. As seen in FIG. 4, installation of the guide unit 120 on a connector having the terminal housing 120 and cover 128, may be accomplished by snapping the toe hooks 157 on the feet of clamp plate over opposite ends of a catch bar to lip 170 that protrudes downward beneath the cover 128, parallel to a back end wall of the cover. With the guide unit 120 in place on a connector, pairs of wire leads from an associated cable may then be dressed over the base wall 122 of the connector, and the leads terminated at corresponding posts as explained above with respect to the connector 10 in FIGS. 1 & 2. Variations in lead dress at the connector terminals will thus be avoided and the rated performance of the connector will be maintained.

While the foregoing description represents preferred embodiments of the invention, it will be obvious to those skilled in the art that various changes and modifications may be made without departing from the spirit and scope of the invention pointed out by the following claims.

We claim:

1. A terminal housing for a communication connector, comprising:

a base wall;

a plurality of first terminal posts disposed along one side of the base wall and a plurality of second terminal posts disposed along an opposite side of the base wall, wherein the terminal posts are configured to receive outside wire leads for establishing electrical connections between the wire leads and connector terminals associated with the terminal posts; and a wire lead guide structure comprising a generally flat wall that extends upward from the base wall intermediate the first terminal posts at the one side of the base wall and the second terminal posts at the opposite side of the base wall, wherein the flat wall has a height sufficient to prevent a first set of wire leads dressed along a first-side of the flat wall and terminating at the first terminal posts, and a second set of wire leads dressed along a second side of the flat wall opposite the first side and terminating at the second terminal posts, from contacting or approaching one another in a manner tending to degrade electrical performance of the connector; and the flat wall of the wire lead guide structure has shoulders that protrude from the first and the second sides of the flat wall, and the shoulders are formed to restrain the first and the second sets of wire leads in a desired dress configuration between the shoulders and the first and the second terminal posts.

2. A terminal housing according to claim 1, wherein the first and the second terminal posts, the base wall, and the flat wall of the wire lead guide structure are formed integrally with one another.

3. A terminal housing according to claim 1, wherein the flat wall of the guide structure has an end face dimensioned and located to confront an end of a cable lead separator of an associated wire lead cable, and to restrain longitudinal movement of the cable with respect to the terminal housing when the first and the second sets of wire leads are terminated at the first and the second terminal posts of the housing.

4. A wire lead guide unit for use with an existing communication connector having a base wall, a bottom cover, a plurality of first terminal posts disposed along one side of the base wall and a plurality of second terminal posts disposed along an opposite side of the base wall, wherein the terminal posts are configured to receive outside wire leads for establishing connections between the wire leads and connector terminals associated with the terminal posts, the wire lead guide unit comprising:

a clamp plate having a pair of vertical legs that extend downward, wherein said legs have feet configured to engage a part of the bottom cover of the connector; and a generally flat horizontal bar joined at one end to the clamp plate;

wherein the horizontal bar is dimensioned and arranged to extend upward from the base wall intermediate the first terminal posts at the one side of the base wall and the second terminal posts at the opposite side of the base wall, and the horizontal bar has a height sufficient to prevent a first set of wire leads dressed along a first side of the bar and terminating at the first terminal posts, and a second set of wire leads dressed along a second side of the bar opposite the first side and terminating at the second terminal posts, from contacting or approaching one another in a manner tending to degrade electrical performance of the connector; and the horizontal bar has shoulders that protrude from the first and the second sides of the bar, and the shoulders are formed to restrain the first and the second sets of wire leads in a desired dress configuration between the shoulders and the first and the second terminal posts of the connector.

5. A wire lead guide unit according to claim 4, wherein the horizontal bar has an end face dimensioned and located to confront an end of a cable lead separator of an associated wire lead cable, and to restrain longitudinal movement of the cable with respect to the connector when the first and the second sets of wire leads are terminated at the first and the second terminal posts of the connector.

6. A wire lead guide unit according to claim 4, wherein the feet on the pair of vertical legs of the clamp plate have mutually opposed toe hooks which are formed to snap about a catch part of the bottom cover of the connector.

7. A wire lead guide unit according to claim 4, including at least one pair of stop members that extend transversely from the first and the second sides of the horizontal bar, wherein the stop members are formed so that distal ends of the stop members closely adjoin adjacent terminal posts at the sides of the base wall to restrain sidewise movement of the bar when installed on the existing communication connector.

* * * * *